US010219963B2

(12) United States Patent
Moletto et al.

(10) Patent No.: US 10,219,963 B2
(45) Date of Patent: Mar. 5, 2019

(54) ARRANGEMENT FOR NEUROPOSTURAL AND SENSORY SUSPENSION OF PREMATURE NEWBORN IN INCUBATORS

(71) Applicant: Valeria Jesica Moletto, Buenos Aires (AR)

(72) Inventors: Valeria Jesica Moletto, Buenos Aires (AR); Edgardo Gabriel Slika, Wilde (AR)

(73) Assignee: Valeria Jesica Moletto, Buenos Aires (AR)

( * ) Notice: Subject to any disclaimer, the term of this patent is extended or adjusted under 35 U.S.C. 154(b) by 93 days.

(21) Appl. No.: 15/623,951

(22) Filed: Jun. 15, 2017

(65) Prior Publication Data

US 2017/0360638 A1 Dec. 21, 2017

(30) Foreign Application Priority Data

Jun. 16, 2016 (AR) ..... P160101793

(51) Int. Cl.
*A61G 11/00* (2006.01)
*A61G 7/10* (2006.01)

(52) U.S. Cl.
CPC ..... *A61G 11/002* (2013.01); *A61G 7/1051* (2013.01); *A61G 11/00* (2013.01)

(58) Field of Classification Search
CPC ..... A61G 11/00; A61G 11/002; A61G 7/1051
USPC ..... 600/21–22
See application file for complete search history.

(56) References Cited

U.S. PATENT DOCUMENTS 5,037,375 A * 8/1991 Gatts ..... A61G 7/065 128/898
5,385,153 A * 1/1995 Jamieson ..... A61G 7/065 128/869

* cited by examiner

*Primary Examiner* — John Lacyk
(74) *Attorney, Agent, or Firm* — Norris McLaughlin, P.A.

(57) ABSTRACT

An arrangement for the neuropostural and sensorial suspension of the premature newborn in incubators, comprising a support for receiving the newborn and connected to an actuator, such that the support is suspended inside the incubator compartment, surrounding the premature newborn so that the newborn is kept in a position similar to that in which it was in the uterus thus allowing its harmonious intrauterine development.

11 Claims, 5 Drawing Sheets

ARRANGEMENT FOR NEUROPOSTURAL AND SENSORY SUSPENSION OF PREMATURE NEWBORN IN INCUBATORS

STATE OF THE ART OF THE INVENTION

Field of the Invention

The present invention relates to the field of equipment, means and arrangements employed for newborns, preferably for premature infants, and more particularly it refers to an arrangement for neuropostural and sensory suspension, hanging, pendant, of the premature newborn which, unlike conventional incubators, allows the newborn to be in a position similar to that in which it was inside the mother's uterus in order to promote the harmonious intrauterine development that newborns should receive prematurely.

Description of the Prior Art

In order to better understand the object and scope of the present invention, it is convenient to describe the current state of the art in reference to premature newborns and disadvantages that arise during the preventive care thereof.

Pathological newborns need a series of special care from birth and during their stay in the monitoring unit or neonatal intensive care unit. This is because they are very likely to present sequelae which are difficult to treat, such as blindness, deafness, cerebral palsy, which in many cases are prevented with adequate follow-up. To this end, parameters such as heart and respiratory rate, temperature, pulse oximetry, blood glucose or serum calcium levels, among other important parameters, should be controlled in the Monitoring Unit. However, despite the increasing internal efficiency of hospitals in their neonatal intensive care units, there a lack of external efficiency due to the lack of follow-up networks that may evolve all levels of health care, either from primary care in the first level to centers of high complexity to solve the most serious problems. This situation is responsible for the death of many children at risk.

Currently, one of the devices used for the treatment of pathological newborns is the incubator. This incubator works as an artificial uterus that recreates an optimal environment for the newborn, being a closed space well insulated thanks to the air filters that are in the ducts to the outside. These filters are able to retain dust and allergens which are in the environment, but also prevent outside bacteria or germs from coming into contact with the newborn. On the other hand, in order to control hydration, not only the temperature of the environment is important, but so is the degree of humidity, since a very dry environment favors dehydration even at low temperatures. The incubator has sensors that when they detect a sensible decrease of the relative humidity they cause the humidifiers of the environment to be activated. In addition, the incubator can include an electronic scale that keeps a continuous record of the weight of the newborn. Thanks to the provision of the scale, it is possible to keep a record of the evolution of the newborn without having to transfer it to other sectors for its respective analysis.

On the other hand, the newborn has on its body surface several electrodes capable of recording basic vital functions. These sensors include an electrocardiogram that records heart rate, an electroencephalogram that records brain activity, and respiratory rate sensors. All of them are adapted to both premature newborns and those who are not. Although the use of the incubator has helped to keep newborns under stable environmental conditions, there are still a number of drawbacks with regard to their posture within incubators.

Premature newborns often lack adequate muscle tone and are at risk of developing abnormal patterns of movement as well as skeletal deformities. Some of the difficulties are related to postural problems and incorrect body mechanics rather than neurological impairments. Hypotonic or decreased muscle tone has been observed in children born with between 28 and 30 weeks of gestation. Correct posture of premature newborns can promote normal motor development and minimize the development of abnormal movement patterns. The position of premature newborns is part of the basic neonatal nursing care and includes supine position, prone position, lateral decubitus position and inclined posture with raised head.

Prone posture has been shown to have many advantages for premature newborns. However, premature newborn is at risk of suffering from postural abnormalities and there is a strong association between prone position during sleeping and Sudden Infant Death Syndrome, with premature newborns representing between 10% and 20% of cases of Sudden Infant Death Syndrome and there is an increasing pressure to avoid this sleeping position in all newborns.

Given the current state-of-the-art available for premature newborns, it would be highly desirable to have a new arrangement that is constituted and built to address the aforementioned drawbacks and, in addition, to allow better conditions for newborns within incubators in order to promote a better development of their neuro-sensory functions.

BRIEF DESCRIPTION OF THE INVENTION

It is therefore an object of the present invention to provide a novel arrangement for the neuropostural and sensory suspension of the newborn which provides better conditions within the incubator so that newborns can properly and appropriately develop in harmonic intrauterine form.

It is yet another object of the present invention to provide an arrangement which avoids the aforementioned drawbacks with respect to the prone and supine decubitus positions.

It is yet another object of the present invention to provide a supporting means which surround the newborn so that it may be in a position similar to that in the mother's uterus.

It is a further object of the present invention to provide actuating means which manage to keep the newborn suspended, surrounded and protected by the supporting means.

It is yet another object of the present invention to provide actuating means which may be robotic, electronic or manual to partially or completely change the position of the newborn.

It is another object of the present invention to provide a supporting means capable of maintaining the temperature of the newborn as well as improving the neurosensorial aspects thereof.

It is yet another object of the present invention to provide an arrangement for the neuropostural and sensory suspension of the premature newborn, which enhances proprioceptive, tactile, vestibular and auditive stimuli, among many others.

It is yet another object of the present invention to provide an arrangement for the neuropostural and sensory suspension of the premature newborn in incubators, wherein the incubators externally comprise a dome or cupola, doors, windows or access portholes, while inwardly comprise a horizontal partition which defines an upper part where the newborn rests and a lower part provided with measuring elements and thermoregulator means, wherein the arrangement comprising at least one supporting means provided at the upper part of the incubator and receiving the newborn, a plurality of tensioners passing through a pair of guide holes provided in the dome of the incubator, and actuating means arranged outside and above the dome or dome of the incubator, said supporting means being connected to the actuating means through the tensioners and suspended in the top of the incubator defining an intrauterine position in the newborn.

It is another object of the present invention to provide an arrangement for the neuropostural and sensory suspension of the premature newborn in incubators, the arrangement comprises at least one supporting means, inside the incubator, for receiving the newborn and keeping the newborn in an intrauterine position, a plurality of tensioners connected to the supporting means, and actuating means for actuating over the plurality of tensioners, said supporting means being suspended from said tensioners and the actuating means are capable of being actuated to move the tensioners and the suspended supporting means for emulating, when desired, any natural intrauterine movement.

BRIEF DESCRIPTION OF DRAWINGS

For the sake of clarity and understanding of the object of the present invention, it has been illustrated in several figures, in which the invention has been represented in one of the preferred embodiments, all by way of example, in which.

DETAILED DESCRIPTION OF THE INVENTION

Referring now to the figures, it is seen that the invention consists of a new arrangement for the neuropostural and sensorial suspension of the premature newborn in incubators, which allows improving its motor development in a correct and harmonic intrauterine manner. However, first and for exemplary purposes, a brief reference will be made to conventional incubators according to FIG. 1 of the prior art.

Figure 1:
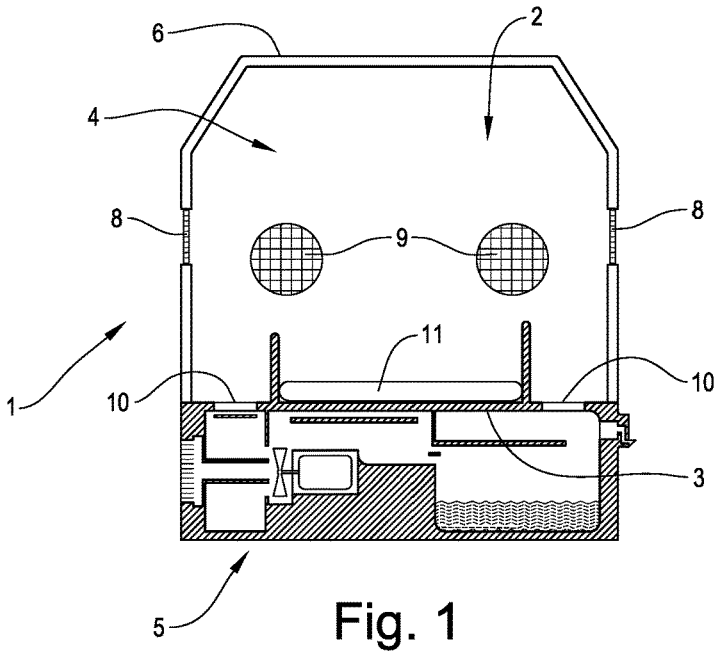
Fig. 1 (Prior Art)
FIG. 1 shows a side cross-sectional view of conventional incubator according to the prior art.
Figure 2:
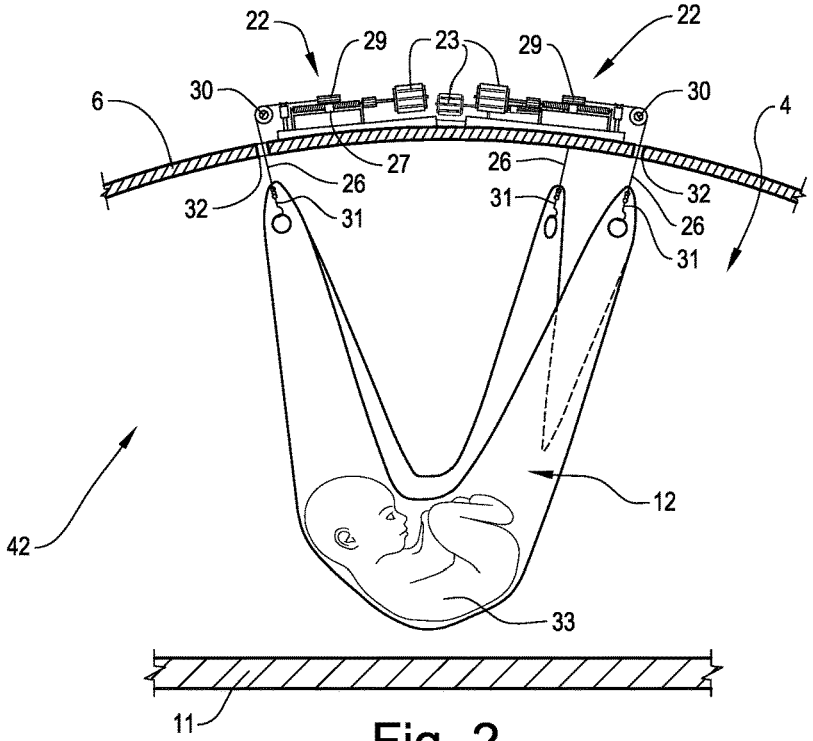
FIG. 2 shows a partial side view of the arrangement according to the present invention, wherein a portion of the incubator has been illustrated by way of illustration and guidance.
Figure 3:
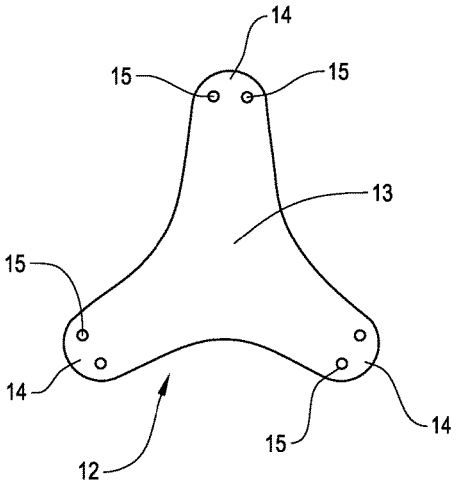
FIG. 3 shows a view of a preferred embodiment of a supporting means according to the present invention.
Figure 4:
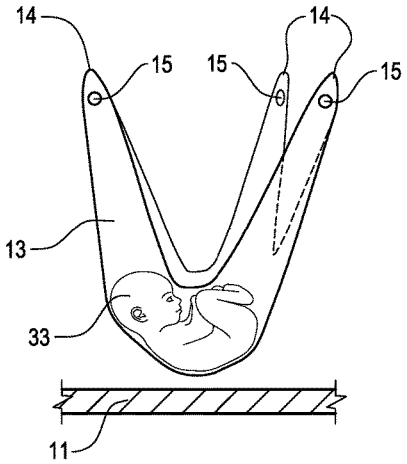
FIG. 4 shows an application of the supporting means of FIG. 3, wherein there is provided a newborn surrounded by said supporting means.
Figure 5:
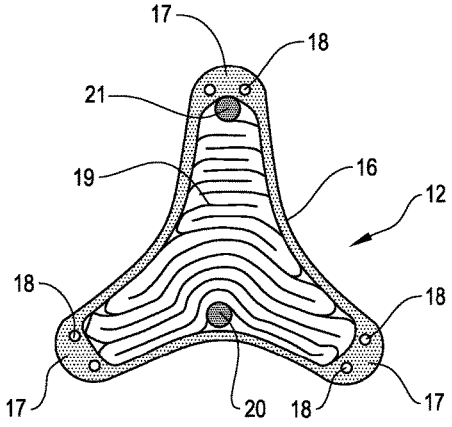
FIG. 5 shows a view of a second preferred embodiment of a supporting means according to the present invention.
Figure 6:
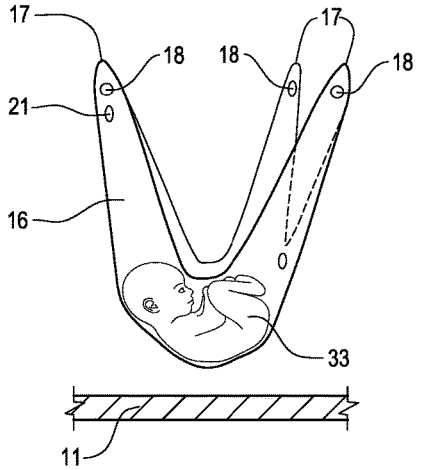
FIG. 6 shows an application of the supporting means of FIG. 5, wherein there is provided a newborn surrounded by said supporting means.

FIG. 1 shows an incubator indicated by the general reference 1 which comprises a closed compartment 2 which has inside a horizontal partition 3 which separates the compartment 2 in an upper part 4 and a lower part 5. The upper part 4 is comprised of an outer dome 6 which can be curved, semi-spherical and transparent to allow visibility into the interior of the compartment 2 and is provided with a pair of air outlets 8 and a plurality of windows or access ports 9 which help specialized staff so that they can carry out their function without any inconvenience.

On the other hand, said lower part 5 of the compartment 2 may be opaque or blind and houses respective measuring elements to carry out a control of parameters of the newborn and thermoregulator means which maintains the environment of compartment 2 in suitable climatic conditions. Generally, such measuring and thermoregulator elements may comprise elements such as scales, sensors, thermostat sensors, bacterial filters, fans or forcing elements, heaters, oxygen gauges, peltier plates, etc., which are well known in the field of art, furthermore not being part of the inventive object of the present invention, and therefore, we will not go into descriptive details about them. Referring again to the horizontal partition it provided with windows or end communication holes 10 which communicate with each other to the upper part 4 and the lower part 5. Said partition 3 is provided with a mattress 11 where the newborn rests in a prone position or supine position.

However, although previous art incubators have proved to be practical, according to studies of Latin American Network of Pediatrics and Neonatology, the following are physiological effects of the different postures (prone or supine position) that the newborn takes in the same.

In relation to heart rate, the prone position is associated with a reduced heart rate, except during sleep, when higher and less variable heart rates are observed in the prone position versus the supine position. No differences were observed in the incidence or duration of mild or clinically significant episodes of bradycardia or cardiac rhythm during the panning between the two positions.

As for oxygen saturation, three studies observed a significant difference in oxygen saturation between the prone and supine positions, whereas two studies found lower oxygen saturation in newborns in the supine position, although this is not reflected is the incidence of clinically significant desaturation. During apnea, a small decrease in mean oxygen saturation was observed both in the prone position and in the supine position.

Regarding lung function, there was no evidence that may suggest significant differences in lung function between the prone or supine positions, except for oxygen-dependent newborns, for whom minute volume and functional residual capacity were higher in the prone position. Respiratory muscle strength was higher in the supine position (with or without head tilt at 45°) than in the prone position.

Regarding pain, no significant differences were observed between groups of prone and supine position for pain response during the invasive procedure of the heel puncture for blood sampling. Newborns placed in the lateral decubitus position and with blanket wrapped by way of contention showed a statistically significant lower mean in pain scores than premature newborns not placed in that position.

On the other hand, cerebral hemodynamics, oxygenation of hemoglobin and cerebral blood volume increased significantly in newborns placed in the supine position compared to those placed is the prone position. After stabilization, prolonged placement in a posture with the head raised 30° to the body did not result in more significant changes in brain hemoglobin content.

Consequently, psychomotor and neurological exams showed a delay in the acquisition of muscular development in premature newborns placed in prone position, compared to newborns placed in supine or lateral position. Electrocortical activity was lower during sleep in newborns placed in prone position compared to those placed in the supine position. It was also observed that premature newborns in prone position lifted their heads much less frequently during sleep than term newborns, posing a risk of suffocation.

By virtue of the foregoing, the inventor of the present invention has developed a novel arrangement, whose neuromuscular result shows that the supine position has a significantly higher score of neuromuscular maturity than the prone position and a more relaxed state, expressed in a significantly lower heart and respiratory rate. In addition, the invention proposes to provide within the incubator sensory stimuli similar to those that the newborn would receive within the uterus of its mother, being this a very significant advantage compared to the conventional one developed so far.

Thus, according to FIGS. 2 to 13, the arrangement for the neuropostural and sensory suspension of the premature newborn in incubators of the present invention is indicated by the general reference 42 and comprises a supporting means 12 which receives the newborn in an wrapping way and which is arranged within the compartment 2 of the incubator 1, more particularly in the upper part 4 above the partition 3. According to FIG. 3, said supporting means 12 may comprise a single pouch 13 having at least three connecting points or ends 14 provided with respective holes or eyelets 15 which will allow connection with actuating means through tensioners which will be described below. Said single pouch 13 may comprise a material selected from the group consisting of textiles of technical use (TOT) such as micro fibers, nonwoven fabrics, nanotechnology special materials, memory polymers, breathable or permeable to gases, etc.

Likewise, said supporting means 12 may also comprise a double thermostated pouch 16 having at least three connecting points or ends 17 provided with respective holes or eyelets 18 connected to actuating means which will be described below. In addition, said double thermostated pouch 16 has at least one fluid trap 19 through which fluid flows between a fluid inlet port 20 and a fluid outlet port 21. Wherein said fluid is a liquid selected from group consisting of aqueous liquids, oily liquids or a combination thereof.

In this way, the double thermostated pouch 16 adopts and transfers the temperature of the recirculating medium by the action of a recirculated thermostated bath for aqueous or oily liquids as required. Preferably, but not limiting to the invention, the choice of oily liquids, i.e. with a viscosity greater than pure water, will be considered to decrease the effects of turbulence on the flow and evaporation into the environment.

On the other hand, and as mentioned above, the supporting means 12 is connected to actuating means 22 through tensioners 26, the actuating means 22 being outside and above the dome 6 and which can be electric, robotic, manual actuators or a combination thereof. In the case of the invention, but not limited thereto, electrical actuating means have been chosen, each comprising a motor connected to a reduction gear free from friction and pulses 24 which in turn is connected to another gear 41 which drives an auger 25 which operates or actuates a die 27 with pulley 29 which is threadedly displaced through the auger 25. A second guide pulley 30 is also provided through which a portion of the tensioner 26 slidably passes, with a connector 28 being also provided, such as an arm or bolt 28, to which one end of tensioner 26 is attached.

It pointed out that said motor 23 is in connection with said gear 24 by means of a shaft 43 and has a timer or "timing" which alternately activates anteroposterior, lateral and pendulum linear movements, the same being programmed according to the requirements of each patient. That is, the motors 23 may operate together or independently of one another to regulate the different heights of each connection point or end of the supporting means. This allows generating different positions in the newborn so that it can be in conditions similar to those under which it was in the uterus. In turn, the arrangement of the pulley 29 enables to reduce the load to lift the newborn as well as, it enables by means of its displacement, the shortening or stretching of the length of the tensioner in order to allow the raising or lowering of the respective end.

It should be noted that control of motors 23 is carried out by means of some known programmable arrangement, such as a CPU, a microcontroller, or a hybrid arrangement, in order to allow the coordination of each of the motors in synchronized form, obtaining as a result the objective movements of the invention. In addition to the programmable unit, a power unit or circuit may be provided which is responsible for transforming the control signal into a useful power value.

On the other hand, each of the tensioners 26 has, at the opposite end to that filed in the connector 28, such as arm or bolt 28, at least one hook 31 which is connected to the holes of the connecting points or ends of the supporting means. In turn, tensioners 26 are guided through guide holes 32 in the cupola or dome 6 of the incubator. In this way and in accordance with FIGS. 2, 4 and 6, it can be seen that, the supporting means 12 is suspended in a "hammock" way inside the upper part 4 of the compartment 2 of the incubator. Likewise, the newborn 33 will be arranged or positioned within the supporting means 12 being in a suspended, wrapped and protected position, similar to the position in which it was inside the uterus.

Figure 7:
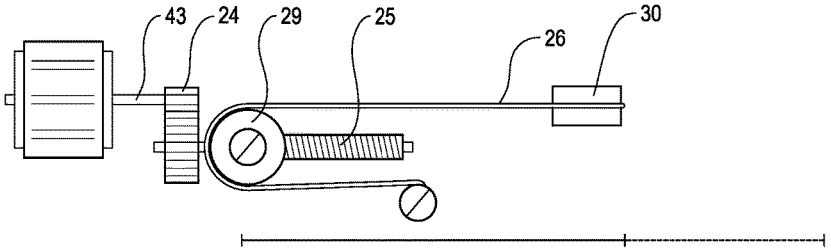
FIG. 7 shows an exemplary view of an actuating means in accordance with the present invention, wherein there is provided a pulleyed die in a position in which a holding member is fully retracted.
Figure 8:
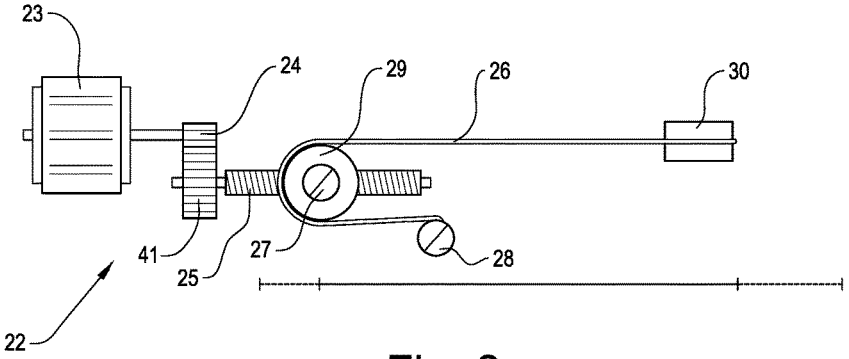
FIG. 8 shows an exemplary view of the actuating means of FIG. 7, wherein said pulleyed die is in an intermediate position.

With regard to the operation of the invention, starting from the position shown in FIG. 7, the motor 23 is first actuated so that it, generates a movement in the auger 25 which allows the die 27 with the pulley 29 to move (FIGS. 8 and 9) in such a way that the tensioner 26 is lowered to a position where the supporting means is deployed or in a free-deployment position, i.e. without the newborn being provided.

Figure 9:
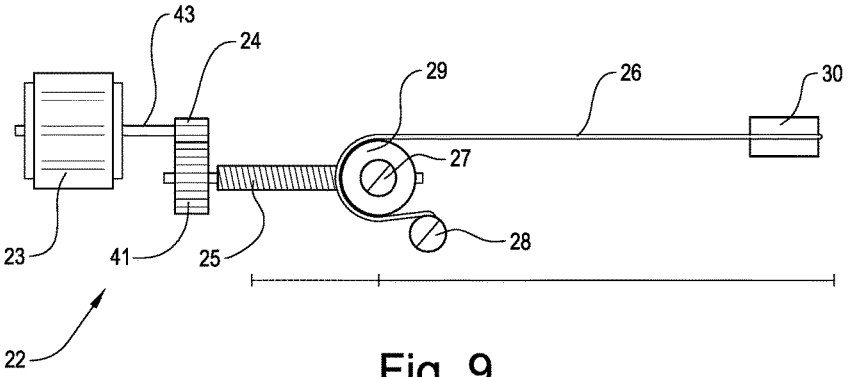
FIG. 9 shows an exemplary view of the actuating means of FIG. 7, wherein the pulleyed die is in a position opposite to that in FIG. 7, wherein the holding member is fully extended.

Once in the deployed position, FIG. 9, the newborn is positioned/placed within the supporting means 12 and the motor 23 is driven to raise the tensioner 26, again returning the pulleyed die to the position which is in FIG. 7. Thus, the supporting means 12 is folded or in a wrapping fold position so that the newborn 29 is in a position similar to that in which it was in the uterus, allowing its intrauterine harmonic development.

Once in the wrapping fold position, the height of each of the connecting points or ends of the supporting means can be varied or modified in order to obtain a correct intrauterine position or posture and similar to the position in which the newborn was inside the mother's uterus. This position may change over the time the newborn is in the incubator. The invented arrangement is able to emulate the mother's movements and positions.

Figure 10:
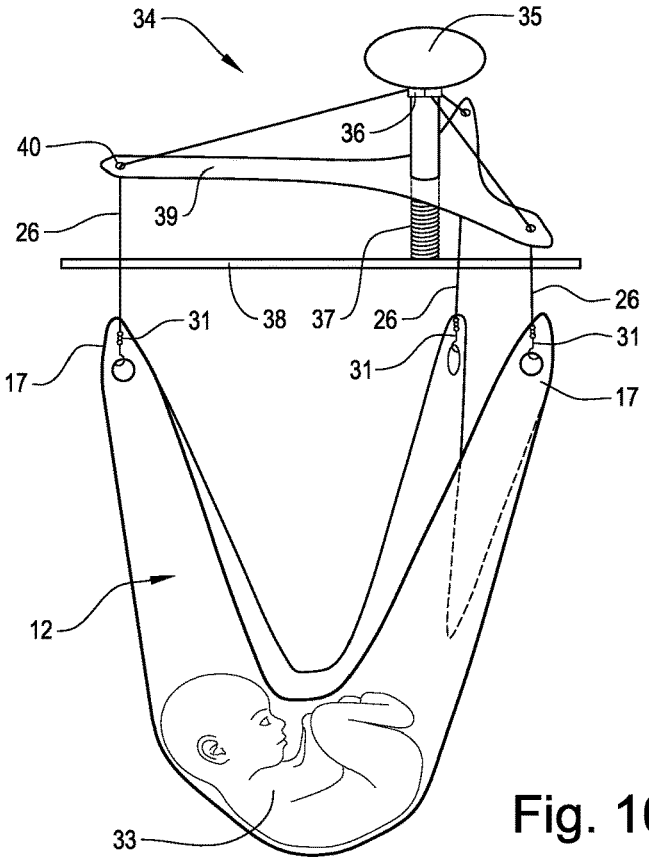
FIG. 10 shows a view of an alternate preferred embodiment of the arrangement, of the present invention, wherein the position of the baby can be varied according to a manual mechanism.
Figure 11:
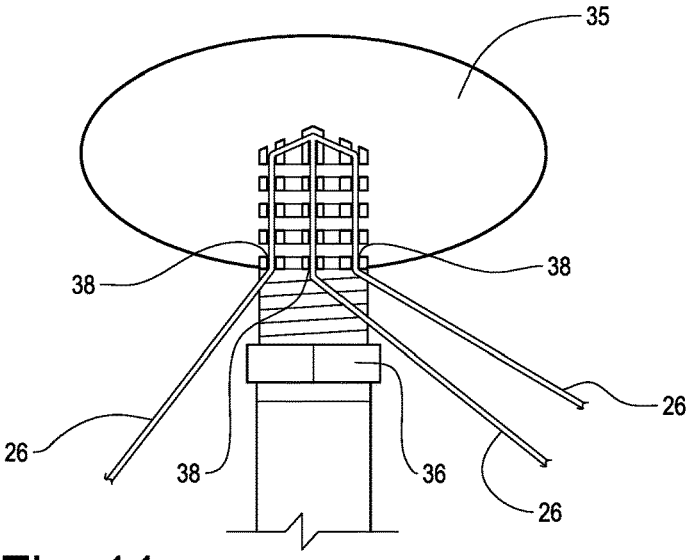
FIG. 11 shows a partial cross-sectional view of a portion of the manual mechanism of FIG. 10, wherein the fixing/adjusting mode of tensioners can be observed.

According to FIGS. 10 and 11, in a second preferred embodiment, the arrangement of the present invention may comprise a manual actuating means 34 which has a pivoting control arm 35 provided with at least one adjusting nut 36 and a lower memory spring 37 mounted on a base 38 which is in turn mounted on top of the dome 6 of the incubator.

Said pivoting control arm 35 has a mounted guide separating plate 39 provided with respective holes 40 which are spaced apart in such a manner as to separate tensioners 26 passing therethrough. It should be noted that each of the ends of the tensioners 26, opposite to the end which is connected to the supporting means 12, will be held at one end of said pivoting control arm 35 through holes 36 and by adjusting the nut 36, as best shown in FIG. 11. In this way, if it is desired to raise or lower one of the connecting points or ends of the supporting means, the person must misalign the nut 36, pull or release cautiously the corresponding tensioner to limit or extend the length thereof, and then, once the desired length of the tensioner has been achieved, adjust again the nut 36. On the other hand, as the pivoting control arm 35 has the spring 37, it can pivot freely so as to generate or transmit movements at the connecting points or ends of the supporting means through tensioners 26 and thus, move the newborn with harmonic movements.

Figure 13:
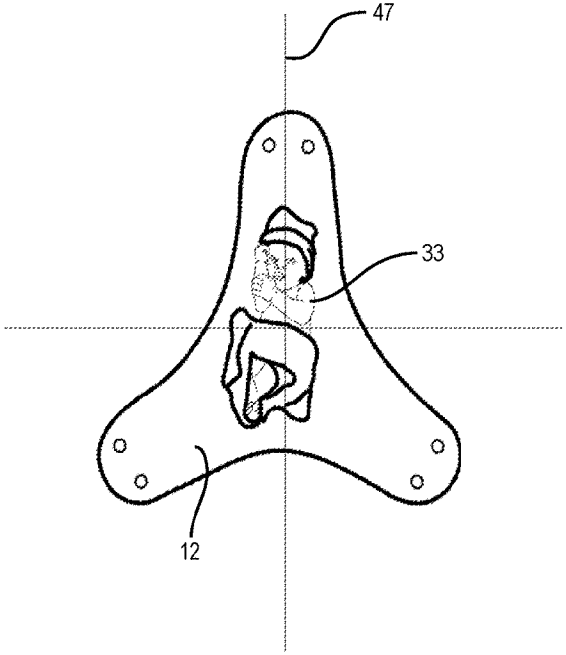
FIG. 13 shows an exemplary partial top view of yet another preferred embodiment to perform axial and longitudinal movements from the supporting means.
Figure 12:
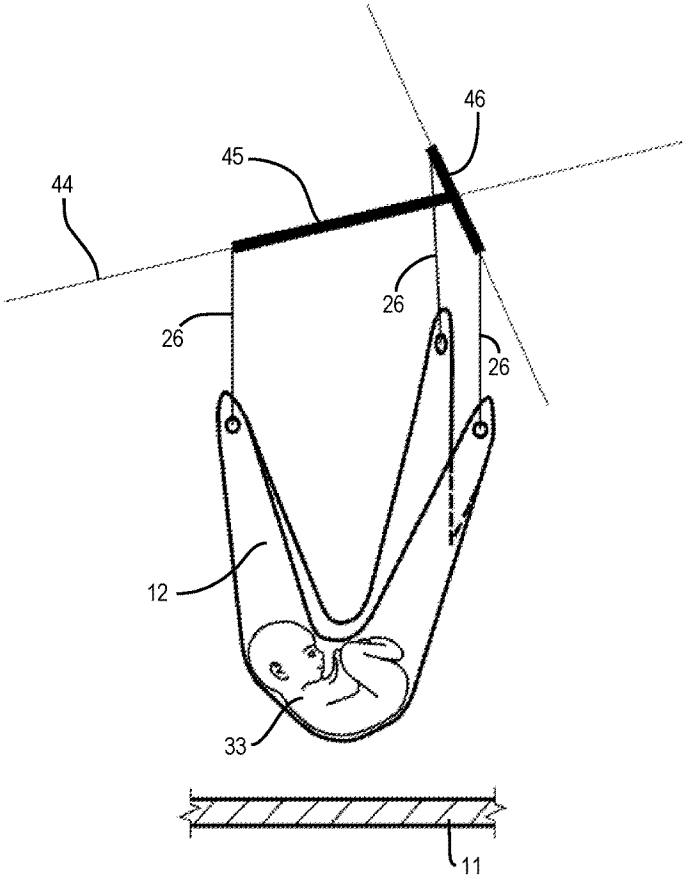
FIG. 12 shows an exemplary partial side view of a series of longitudinal and axial movements which can be carried out from the top of the incubator.

In relation to the general movements that can be performed by the present invention, FIGS. 12 and 13, at least four different types of movements will be described below, wherein each described movement takes as reference a theoretical axis of rotation in the space. Thus, a first movement may be that movement in the longitudinal axis above the incubator, where there is an alternating lateral swinging motion, such as "lateral hammock", in which a rotation axis 44 is located longitudinally above the cover, more precisely by drawing a line 45 between the center of the two side motors, and the center of the front motor. A second type of movement can be carried by a transverse axis above the incubator, being an alternate anteroposterior linear movement such as "front hammock" type, in which the axis of rotation 46 is located transversely above the cover of the Incubator, more precisely by drawing a line between the two side motors.

Yet another type of movement may be that movement in the longitudinal axis of the supporting means 12, being an alternate rotation movement on an axis which is formed by drawing a longitudinal line between the center of the feet and the head of the newborn 33, similar to rotating on an own axis 47. Another type of movement can be that oscillatory movement of two alternating axes, achieving by this movement a sensation of being on a disc in which a point that rotates in its perimeter pushes the disc down, simulating an alternating descent and ascending rotation. Where, this type of movement is geometrically represented with two orthogonal axes which rotate towards both sides with harmonic senoidal and cosenoidal movements respectively. Although at least four types of movements have been described, this does not imply that the invention is limited thereto, but that other movements and combinations may be considered and carried out without any inconvenience.

According to some of the problems of prior art, a newborn who is born prematurely, is exposed to light, sound, proprioceptive and tactile stimuli that are not part of normal development; which are necessary to guarantee survival, but which nevertheless directly affect the CNS of that newborn child who is in the process of development. However, thanks to the use of the present invention, an early and timely intervention is performed in newborns, whose intrauterine development process was interrupted by promoting an effective approach and taking care of the safety of that being. In turn, an adequate neuropostural control is provided within the incubator, coupled with vestibular, proprioceptive and tactile stimuli, favoring an approximation to the intrauterine harmonic development that prematurely born infants should receive.

Among major stimuli which are improved by the invention, the following shall be found:

Proprioceptive stimulation: The newborn will maintain the posture of physiological flexion. The upper limbs will be adducted near the face, the lower limbs will be flexed. This allows their somatosensory systems to continue their developmental process in the posture more similar to the one that they would have in the uterus. Let the weight discharge be placed on the back, precisely on the vertebral column, favoring greater sensorial input of said area.

Tactile stimulation: When being suspended on the support medium, which presents a material with memory, the newborn perceives the contact of a smooth, container surface, which allows it to exercise movements in an organized and controlled manner. The tactile stimulus will be greater in the posterior part of its body, which favors the sensorial input in the vertebral column, through which nervous fibers enter and leave (Lemniscal and Extralemniscal System), which are conveying the different sensations towards the cerebral cortex, which, in the process of myelination and development, should organize these sensations to generate a motor-type response that will travel through the pyramidal and extrapyramidal pathways, also in the process of development and myelination.

Vestibular stimulation: the possibility of providing anteroposterior and pendular linear movements, favor the development of vestibular systems that will intervene in the equilibrium and straightening reactions.

Alternatively, the arrangement of the present invention may include an audio system which allows the reproduction of recordings containing the sound of the mother's heartbeat, her voice and that of her direct relatives.

In this way, the arrangement for the neuropostural and sensory suspension of the premature newborn in incubators is constituted and built, which allows positioning the newborn in a position similar to that in which it was in the uterus is order to allow its harmonious intrauterine development. Also, the invention achieves potential benefits in the Prevention of Neurohortopic Disorders such as torticollis, kyphoscoliosis; Prevention of Neurosensory Disorders, whether tactile such as integration disorders and sensory processing such as oral defensiveness, tactile defense among others, or Visual disturbances such as strabismus; and in the Prevention of Vestibular Disorders such as poor or exaggerated equilibrium and straightening reactions, as well as hypo or hyperreactive Newborns, among other benefits.

The invention claimed is:

1. An arrangement for the neuropostural and sensory suspension of the premature newborn in incubators, the arrangement comprises:

at least one supporting means, inside the incubator, for receiving the newborn and keeping the newborn in an intrauterine position, a plurality of tensioners connected to the at least one supporting means, and actuating means for actuating over the plurality of tensioners, said at least one supporting means being suspended from said plurality of tensioners and the actuating means are capable of being actuated to move the tensioners and the suspended supporting means for emulating any mother's movement.

2. An arrangement according to claim 1, wherein the incubator comprise a dome and inward horizontal partition defining an upper part where the newborn rests and a lower part provided with measuring elements and thermoregulator means, wherein the at least one supporting means is provided at the upper part of the incubator, with the plurality of tensioners passing through a pair of guide holes provided in the dome the incubator, and the actuating means being arranged outside and above the dome of the incubator.

3. An arrangement according to claim 1, wherein said at least one supporting means comprises a single pouch having at least three connecting points provided with respective holes connected to said tensioners.

4. An arrangement according to claim 2, wherein said at least one supporting means comprises a double thermostated pouch having at least three connecting points provided with respective holes which are connected to said tensioners and at least one fluid trap through which a fluid flows between a fluid inlet port and a fluid outlet port.

5. An arrangement according to claim 4, wherein said fluid is a liquid selected from the group consisting of aqueous liquids, oily liquids or a combination thereof.

6. An arrangement according to claim 1, wherein said actuating means are selected from the group consisting of electric, robotic, manual actuating means or a combination thereof.

7. An arrangement according to claim 1, wherein said actuating means comprises at least one motor connected to a reduction gear free from friction and pulses, which in turn is connected to another gear which drives an auger which actuates a pulleyed die slidably receiving a portion of the corresponding tensioner.

8. An arrangement according to claim 7, wherein said actuating means is provided with a guide pulley through which a portion of the tensioner passes and a connector where one end of said tensioner is secured.

9. An arrangement according to claim 8, wherein each of the tensioners has, at another end opposite to said one end fixed to the connector of the actuating means, a hook which is connected to a respective hole of the connecting points of the at least one supporting means.

10. An arrangement according to claim 6, wherein said actuating means comprises a manual actuator which has a pivoting control arm provided with an end with holes, at least one adjusting nut and at least one lower memory spring mounted on a base which is in turn mounted on the upper part of the dome of the incubator.

11. An arrangement according to claim 10, wherein said pivoting control arm has a mounted guide separating plate provided with respective holes which are spaced apart in such a manner as to separate the tensioners passing therethrough, wherein said another end of each of the tensioners, is held in one of said holes of the end of the control arm and adjusted by said nut.

* * * * *